United States Patent [19]

Kuramochi

[11] 4,050,567

[45] Sept. 27, 1977

[54] SHIFT MECHANISM FOR TYPEWRITER

[76] Inventor: Shigeaki Kuramochi, 24-17 5 Chome, Koishikawa Bunkyo, Tokyo, Japan

[21] Appl. No.: 651,920

[22] Filed: Jan. 23, 1976

Related U.S. Application Data

[63] Continuation-in-part of Ser. No. 476,847, June 6, 1974, Pat. No. 3,934,697.

[51] Int. Cl.[2] ..... B41J 11/14

[52] U.S. Cl. ..... 197/72; 197/73

[58] Field of Search ..... 197/71, 72, 73, 79, 197/80, 81

[56] References Cited

U.S. PATENT DOCUMENTS

| | | | |
|---|---|---|---|
| 1,071,976 | 9/1913 | Weeden | 197/72 |
| 1,412,637 | 4/1922 | Uhlig | 197/72 |
| 1,433,935 | 10/1922 | Campbell | 197/72 |
| 1,586,090 | 5/1926 | Kurowski | 197/72 |
| 2,705,553 | 4/1955 | Thomson | 197/79 X |

*Primary Examiner*—Edgar S. Burr
*Assistant Examiner*—Paul T. Sewell
*Attorney, Agent, or Firm*—Pennie & Edmonds

[57] ABSTRACT

A shift mechanism for typewriters has the capability of moving the carriage and a platen supported thereby from a first position to a second or third position along a longitudinal path on opposite sides of the first position. The first position is the normal or center position of the carriage for typing letters in lower case. The second or upper and the third or lower positions of the carriage are positions to which the carriage is actuated by the shift mechanism for typing other forms of indicia such as letters in upper case, symbols and numerals or combinations of the same. The shift mechanism including a plurality of pivotable levers operating in concert and actuated by finger engageable levers actuate the carriage from the first position to one of the other positions for change-over of the form of indicia desired. The shift mechanism may be locked in the upper position for typing letters in upper case.

9 Claims, 7 Drawing Figures

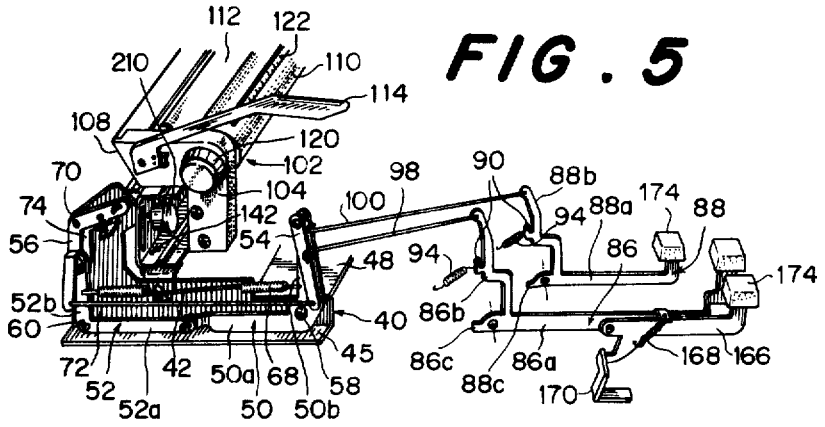
FIG. 5
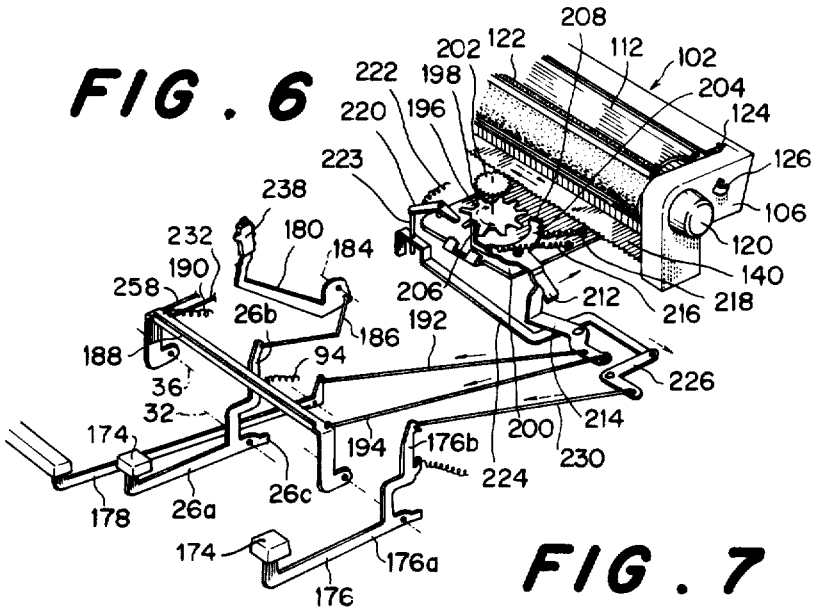
FIG. 6
FIG. 7
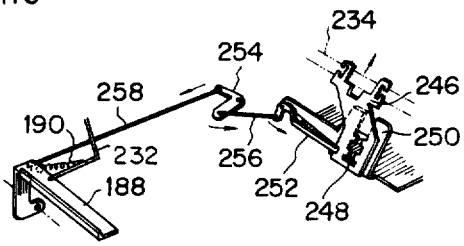

SHIFT MECHANISM FOR TYPEWRITER

REFERENCE TO RELATED APPLICATIONS

The present application is a continuation-in-part of application for Letters Patent Ser. No. 476,847, filed on June 6, 1974, now U.S. Pat. No. 3,934,697.

BACKGROUND OF THE INVENTION

The prior art is replete with typewriter constructions having capability of shifting a carriage and a platen from one position to another position relative to a type bar thereby to enable the operator to choose one of two or more forms of indicia carried by the type bar for transfer to a paper carried by the platen.

In the previously known construction of shift mechanism for purposes as described herein, however, movement of the carriage for the change-over of types, such as from lower case to upper case letters, has been carried out by means of complicated and expensive mechanisms. To this end, cost criterion has been such that these mechanisms are unsuited for use in the variety of typewriter which is sold on the children's market.

SUMMARY OF THE INVENTION

The shift mechanism of the present invention seeks to overcome the disadvantages of the prior art as set out above. As such, the present invention is directed to an improved typewriter and importantly to a shift mechanism which is extremely inexpensive to manufacture, has a minimum of operative parts and yet embodies all of the essential features required for rapid, positive movement of the carriage upon command of change-over of type from one form of indicia to another.

For carrying out the invention, the shift mechanism includes a plurality of pivotable levers which are operatively connected between a frame for supporting the carriage and a plurality of finger engageable levers which command movement of the frame and carriage in one direction or the other along a path from a center position. The carriage, thus, will position a platen carried thereby in the path of movement of one of a plurality of type faces disposed on a type bar. The pivotable levers are four in number, each being pivoted about separate pivot axes. A pair of the levers are pivoted in unison in one direction by a finger engageable lever for movement of the carriage in the first-noted direction (to the upper position), while these levers following movement of the other pair of levers which pivot in different directions pivot in unison in the other direction for movement of the carriage in the second-noted direction (to the lower position). This latter movement is imparted to the pivotable levers by a second finger engageable lever.

The pivotable levers may be provided in arrays on opposite sides of the carriage for better control of movement. These pivotable lever arrays are ganged together and either of the pivotable lever arrays may be directly controlled by the former of the finger engageable levers, at least one of which may be locked in the carriage actuating position for continuous transfer of letters of upper case.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DESCRIPTION OF THE DRAWING FIGURES

FIG. 5 is a partial perspective view of the mechanism for shifting the carriage from the position of FIG. 2 to the position either as illustrated in FIG. 3 or FIG. 4;

FIG. 6 is a partial perspective view of the mechanism for advancing the carriage in a typing direction or for backspacing the carriage; and, FIG. 7 is a partial perspective view of the mechanism for raising the ribbon support and ribbon relative to the carriage.

DESCRIPTION OF THE PREFERRED EMBODIMENT

Figure 1:
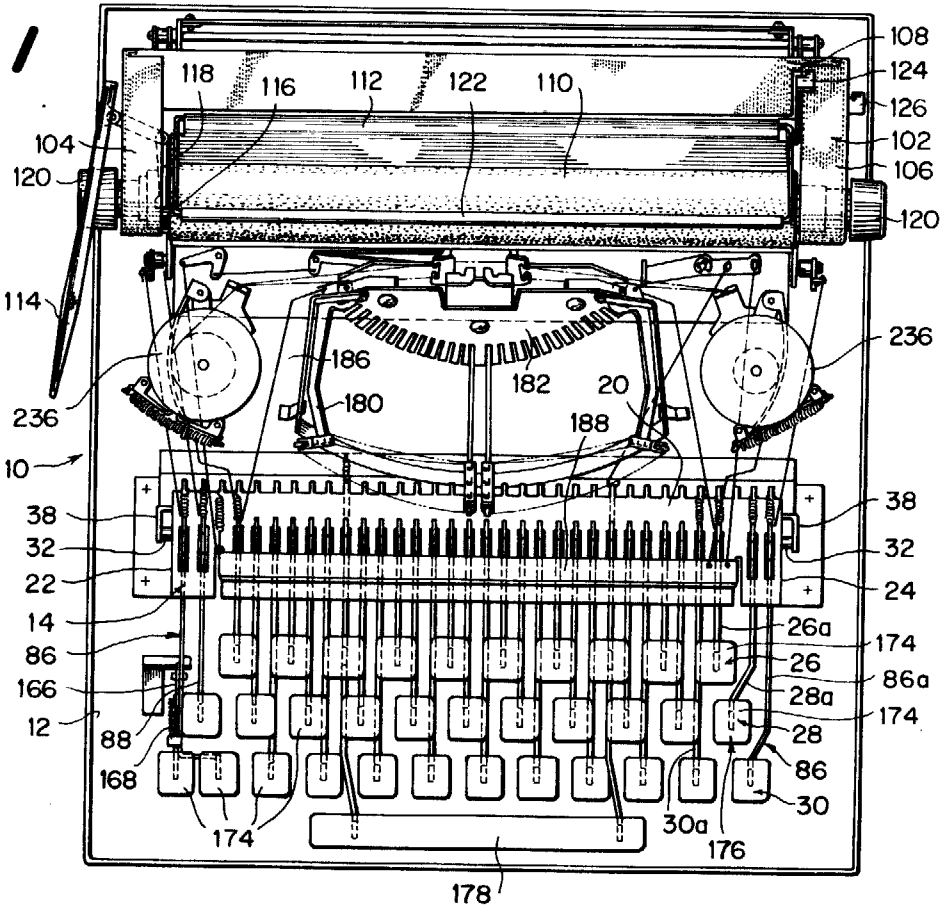
FIG. 1 is a top plan view of the typewriter of the present invention with the cover removed for purposes of illustration of certain of the operating mechanisms.

The present invention is directed to the operating mechanism of a typewriter for shifting the carriage from a first typing position to one of either a second or third typing position as determined by the form of indicia to be produced on a length of paper carried by a platen. The shifting capability increases the versatility of the typewriter which may have a smaller than standard sized keyboard. For example, in the first typing position which may be a center position of the carriage, the typewriter may function to produce letters in lower case on the paper while in the other positions of the carriage, numeric and/or symbol indicia, and letters in the upper case, respectively, may be produced on the paper. In the preferred embodiment, letters in upper case may be produced on the paper while the carriage is in the second or elevated typing position and numeric and/or symbol indicia may be produced on the paper while the carriage is in the third or lowered typing position. The "elevated" and "lowered" typing positions are positions relative to the position of the carriage of FIG. 2.

Attention now may be directed to FIGS. 2–5 which illustrate the mechanism for shifting the carriage to best advantage. The mechanism for shifting the carriage or shift mechanism generally includes a plurality of articulatable levers supported in the vicinity both of the front and to the rear of a base plate 12 of typewriter 10. These levers are connected together by a plurality of linkages. Each of the levers are supported for pivotal movement by forwardly and rearwardly disposed frame structure carried by and extending upwardly of the base plate in the respective regions.

The forwardly disposed frame structure in the form of a housing 14 supports a plurality of levers comprising a keyboard of the typewriter (see FIG. 1), which keyboard includes the operating levers of the shift mechanism. The levers of the shift mechanism illustrated in FIGS. 2 and 5 are those levers located to the left side of the keyboard and include a lever for moving the carriage to the second position, a lever for locking the carriage in the second position, and a lever for moving the carriage to the third position. A further lever for moving the carriage to the second position is located to the right side of the keyboard. The latter lever, however, cannot be locked, as is common in most typewriters. The housing includes a front wall 16, a rear wall 18 having an offset portion near the base plate, a top wall 20 which overhangs the rear wall and a pair of side walls 22, 24. Each of the rear wall (above the offset portion), the front wall and top wall include an elongated slot for receipt therethrough of portions of individual ones of the articulatable levers extending rearwardly from the area of the keyboard. The length of the slots, as will become clear, determines the extent of pivotal movement each of the levers will undergo.

Figure 2:
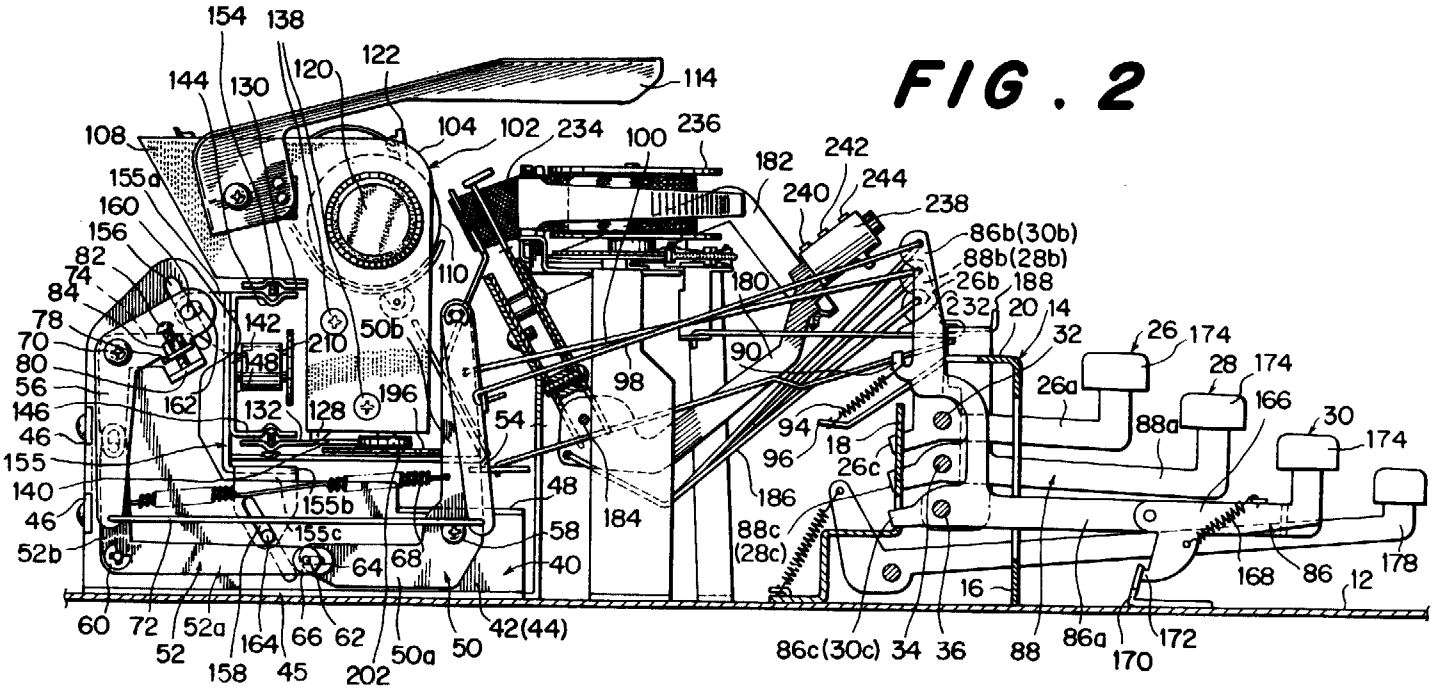
FIG. 2 is a view in side elevation of the typewriter of FIG. 1 illustrating the carriage in a first typing position.
Figure 3:
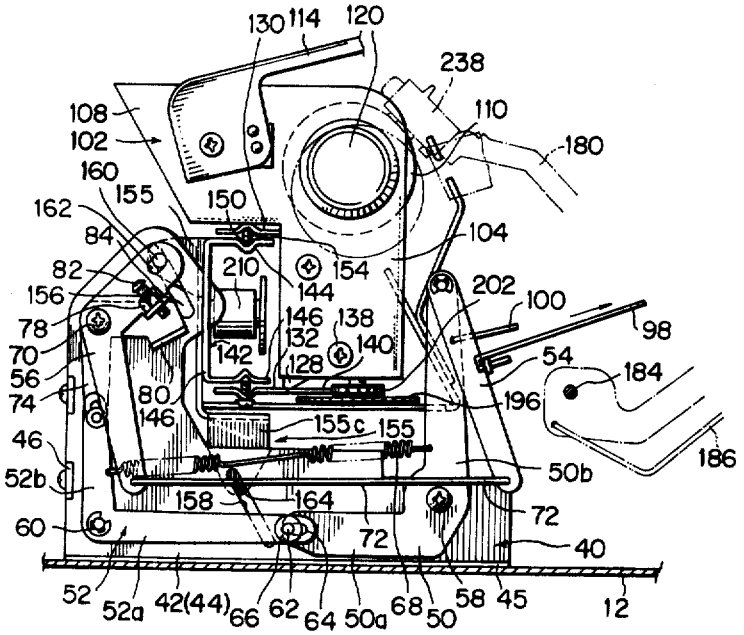
FIGS. 3 and 4 are partial views similar to FIG. 2 yet illustrating the carriage in a second and third typing position, respectively.
Figure 4:
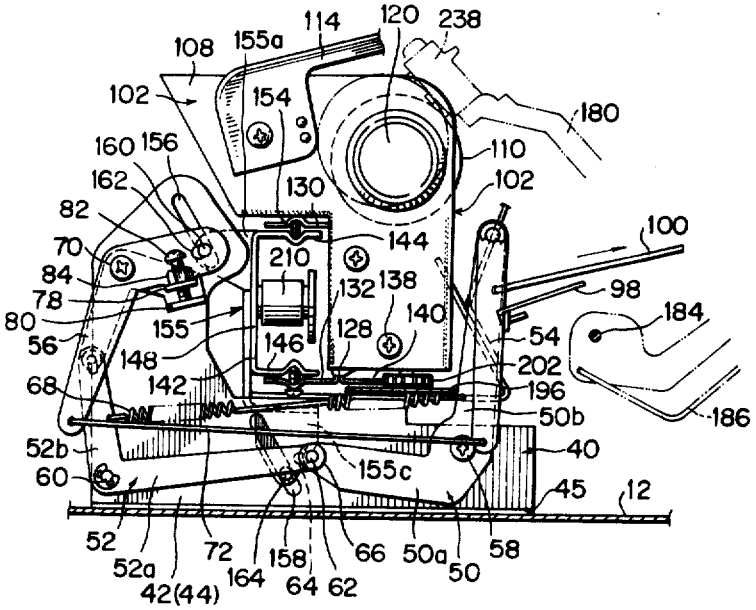

With reference to FIGS. 1 and 2, the keyboard of the typewriter includes a plurality of three tiers of levers 26, 28 and 30, with a plurality of keys in each tier which extend substantially across the housing 14.

Each of the levers of the several tiers of levers are formed substantially similarly thereby to define a mounting portion, a forwardly directed arm 26*a* (28*a* and 30*a*), an upwardly directed arm 26*b* (28*b* and 30*b*) and a rearwardly directed arm 26*c* (28*c* and 30*c*). Each of the forwardly directed arms 28*a* and 30*a*, hidden in FIG. 2 by the forwardly directed arms of the shift levers may be seen in FIG. 1, while each of the upwardly directed and rearwardly directed arms of the levers, some of which are hidden in FIG. 1, may be seen in FIG. 2. Each of the arms of each lever of the tiers extends through a slot in the housing. The levers are mounted by a plurality of rods 32, 34 and 36 which extend in substantially a vertical array across the housing 14. Each lever is mounted on one of the rods which is received through an aperture in the mounting portion. Particularly, the levers in the first tier of levers are mounted on rod 32 while the levers in the descending tiers of levers are mounted on rods 34 and 36, respectively. The rods are supported within the housing by the side walls 22 and 24 and immobilized axially by a pair of tabs 38 which may be extensions of the rear wall 18.

The rearwardly disposed frame structure 40 includes a pair of side elements 42, 44 and a rear element 46 which extends therebetween. The side elements generally are of L-shaped outline with the base leg juxtaposed to the base plate 12. The rear element is connected to the upstanding legs. A forward element 48 is carried on the base legs of the side elements and provides a supporting surface for structure to be discussed below. The frame structure 40 may be comprised of a unitary structure or by separable parts connected together in any convenient manner and is secured to base plate 12 by means of a plurality of screws received through a flange 45 which extends outwardly of each of the side elements.

The levers of the shift mechanism which are located rearwardly of base plate 12 are duplicated on opposite sides of frame structure 40. This structure of the shift mechanism includes a lever 50 and a lever 52. The respective levers are pivotable about pivot axes 58 and 60 formed by stub shafts which extend through the side elements 42 and 44. Each of the levers includes a pair of legs *a* and *b* which extend substantially at right angles one to the other. The legs 50*a* and 52*a* are connected together by a pin 62. The pin may be integral with one leg and may extend through a slot 64 formed in the other leg. Particularly, pin 62 extends from the leg 50*a* through the slot 64 formed in leg 52*a*. Securement for pivotal movement is provided by a fastener 66 received on the extended portion of the pin juxtaposed to the surface of the leg 52*a*. A spring 68 is connected at its ends to the legs 50*b* and 52*b* for purposes of biasing the lever 50 in the counterclockwise direction and the lever 52 in the clockwise direction. The structure of the shift mechanism includes a lever 54 and a lever 56. These levers, also, are mounted for pivotal movement. In this connection, the lever 54 is pivoted at one end of the leg 50*b* of lever 50 while the lever 56 is mounted on the end of a rod 70 which extends between and is supported by the side elements 42 and 44. The lever 56 is keyed or otherwise secured to rod 70 so that any movement imparted directly to the lever on one side or the other during actuation of the carriage from the first to the second position will result in following movement of the levers on the other side of the base plate 12. Movement of lever 56 (the left side lever) following actuation of the carriage from the first to the third position similarly will result in following movement of the levers on the other side of base plate 12. A link 72 is connected between the end of lever 54 opposite its pivot point and one end of lever 56. A crank 74 is carried by rod 70 in a position juxtaposed to the side elements 42 and 44. A collar 76 maintains a spacing between the crank and lever 56. The crank is connected to the leg 52*b* of lever 52 in any manner such as heretofore discussed with regard to the connection of legs 50*a* and 52*a*.

A tab 78 extends outwardly from the lever 56. A second tab 80 extends outwardly from crank 74. The tabs provide a stop for pivotal movement of the lever 54 when the carriage returns from the second to the first position. A screw 82 may be received through the tab 78 and threaded into engagement with the upper surface of tab 80. A locknut 84 is provided for securing the screw in any threaded position. Adjustment of the screw 82 serves to adjust the disposition of the first position of the carriage relative to the second and third positions.

Movement is imparted to the levers 54 and 56 through pivotal movement of the shift levers 86. The shift levers 86, located on opposite sides of the keyboard, are provided for actuating the carriage from the first to the second position. Movement is imparted to the levers 50, 52, 54 and 56 through pivotal movement of the shift lever 88. Shift lever 88, located to the left of the keyboard, is provided for actuating the carriage from the first to the third position. The shift levers 86 and 88 may be referred to as the upper case lever and the indicia lever, respectively.

The upper case lever is disposed in the lowest tier of levers of the keyboard while the indicia lever is disposed in the middle tier of levers of the keyboard. The rods 34 and 36 for mounting the upper case and indicia lever, as indicated, are arranged in vertical alignment, not as illustrated in FIG. 5. The latter showing is only for purposes of providing a clear illustration of the structure of each lever.

As was the case with the levers 26, 28 and 30, the upper case lever 86 includes a forward arm 86*a* which extends through a slot in the front wall 16, an upward arm 86*b* which extends through a slot in the top wall 20 and a rearward arm 86*c* which extends through a slot in the rear wall 18, all of housing 14. The indicia lever 88 is substantially identical in form to the upper case lever 86. The indicia lever is located in the second tier of levers and mounted for pivotal movement on rod 34.

Each of the levers including the levers 26, 28 and 30, as well as the upper case lever 86 and indicia lever 88 are provided with an ear 90 extending from the upward arm. A plurality of tabs 96 are formed at the rearward extremity of the top wall 20 across the housing 14. The tabs are provided in a number equal to the number of ears and are in alignment with the ears and provide a point of connection of one end of a spring 94, the other end of which is connected to the ear. The spring 94 serves to bias each of the levers in a counterclockwise direction (see FIG. 2).

A link 98 is connected at one end to the upward leg **86*b* of upper case lever 86 and at the other end to the third lever 54 at a location spaced from the pivot axis of the lever. A link 100 is connected between the upward leg 88*b* of indicia lever 88 and first lever 50**.

Movement of the carriage from the first to the second position is controlled by the upper case lever 86. Movement of upper case lever 86 against the bias of spring 94 causes the lever 54 and lever 56 through the links 72 and 98 to pivot in the counterclockwise direction. Movement of the carriage to the third position is controlled by the indicia lever 88. To this end, pivotal movement of indicia lever 88 against the bias of its spring 94 results in the lever 54 and lever 56 pivoting in the opposite direction. To this end, the indicia lever 88 is connected to the lever 50 by link 100 and when moved in the direction in opposition to the bias of spring 94 causes the lever 50 to pivot clockwise. The lever 52 connected to the lever 50 as described pivots counterclockwise. Pivotal movement of the lever 52 in the counterclockwise direction is followed by clockwise movement of crank 74. The crank is keyed or otherwise secured to rod 70 during movement in the clockwise direction from the center position of the carriage. This movement is followed by like movement of the lever 56. Pivotal movement of the lever in the other direction from the center position has no effect on movement of crank 74.

The carriage 102, a term which has been used heretofore in reference to all of the structure to which movement is imparted by the shift mechanism, now will be described. Generally, the carriage includes a movable housing having a pair of side members 104, 106 and a rear member 108 which traverses between and is connected to the side members. The side members support a platen 110, a paper guide 112 and a paper advance lever 114 acting through mechanism including a ratchet 116 and pawl 118 for incrementally rotating the platen. The ratchet is disposed on the shaft of the platen and the pawl of the advance lever is biased to a position out of contact with the ratchet so that the platen otherwise may be freely manipulated in either direction of rotation. To this end, a pair of knobs 120 extend through the side members and are connected to the shaft of the platen. A bar 122 is supported by the paper guide and biased (by means not shown) into contact with the platen and the paper (also not shown). One of the side members, additionally, supports a paper guide lever for moving the paper guide relative to the platen 110 which allows free movement of the paper. A disconnect lever 126 is adapted to disengage the carriage from the key actuated mechanism thereby to permit free movement of the carriage to both the right and the left (FIG. 1). The paper guide is biased into close juxtaposition with the platen for frictional engagement of the paper by the platen so that the paper may be advanced or retracted upon rotation of the platen.

The carriage includes a track 128 formed by a pair of parallel, coextensive guide plates 130 and 132 which extend rearwardly of the base plate 12 and which are connected by a web portion (not shown). A pair of tabs are carried by the web portion. The tabs are bent forwardly of the face plate 12 thereby to lie in juxtaposition to the inner surface of side members 104 and 106 which are connected to the tabs by one or more screws 138 or the equivalent. A rack 140 is supported by the web portion in a disposition such that the teeth extend forwardly to cooperate with the key actuated mechanism.

A track mount 142 is similarly formed. To this end, the track mount includes a pair of parallel, coextensive guide plates 144 and 146 which extend forwardly of the base plate 12 and which are connected by a web portion 148. The web portion 148 of the track mount has a width less than that of the web portion of the track 128 so that the latter described guide plates are disposed between yet juxtaposed to the former guide plates. The cooperating guide plates are formed with oppositely directed V-shaped channels. A bearing race may be located in each pair of cooperating channels for ease in movement between limit positions, defined by a projection 150 extending into one channel of each pair of channels. The projections are adjacent the ends of the channels and serve as stops for a plurality of members in the form of screws 154 extending into the other channel of each pair of channels.

A pair of connecting members 155 are supported by the web portion 148 of the track mount adjacent its ends. Each connecting member includes a portion supported by the web portion and a portion which extends below the web portion toward the base plate 12 and angled forwardly beneath the track mount in spaced parallel relation to the base plate 12. Each of the connecting members adjacent to the upper portion of the web portion 148 includes a rearwardly directed ear **155*a* while the angled portions 155*b* are formed with downwardly projecting ears 155*c*. The connecting members 155 serve as a mount for the carriage 102 on frame 40**.

Referring more particularly to the manner of mounting of the carriage, the side elements 42 and 44 include a pair of slots 156 and 158, one of which is located in the leg portion and the other of which is located in the extending portion. Each of the slots 156 and 158 are disposed in a like angular disposition and the axes of each of the slots are parallel. A rod 160 extends through each of the ears **155*a* of connecting members 155, the slots 156 and a slot 162 formed in the other leg of the fourth lever 56. The rod 160, as the rod 164, may be axially immobilized in any convenient fashion. Further, rod 164 extends through each of the ears 155*c* in connecting members 154 and through the slots 158 for purposes of rotational stabilization of movement along a path from the first to the second position or from the first to the third position. The path of movement will be parallel to the axes of slots 156 and 158**.

The upper case lever 86 may be locked thereby to maintain the carriage 102 in the second position. To this end, the forward arm **86*a* of the upper case lever 86 mounts a lock lever 166 which is movable with the arm 86*a* of the upper case lever 86 and movable relative to the arm about a pivot axis in opposition to the bias force of spring 168. The spring 168 is connected between one arm of the lock lever 166 and a tab carried by the arm 86a of upper case lever 86. A locking member 170 is carried by the base plate 12 and provides an extending tab under which a finger 172 of the aforementioned arm of the lock lever 166 may be received. The finger 172 may be released from beneath the tab of the locking member 170 by a depressing force on arm 86a of upper case lever 86**.

Each of the levers 26, 28 and 30 including the upper case lever 86 and indicia lever 88 and a backspace 176 carry a finger pad 174 on their forward extending arms 26a, etc. Each of the pads may present the form of indicia to be transferred to the paper.

Advancement of the carriage 102 in the typing direction may be effected by sequential actuation of any one of the levers 26, 28 and 30 or through actuation of the space bar 178. The operation may be appreciated through reference to FIG. 6. To this end, a plurality of type bars 180 equal in number to the number of levers 26, 28 and 30 are pivotally supported by a supporting member 182 in the form of a basket and movable about a pivot axis defined by a rod 184 carried by the supporting member. In FIG. 6 the rod 184 is represented by a dotted line extending through an aperture formed in the bulbous portion of the type bar 180. A connecting link 186 is coupled at its ends to the bulbous portion of the type bar and to the upward arm for example, arm 26b of lever 26. As illustrated in FIG. 6, pivotal movement of lever 26 about rod 32, illustrated as a dotted line, in the counterclockwise direction imparts clockwise movement to the type bar for engagement with the paper carried by platen 110. Each actuation of a lever such as lever 26 results in pivotal movement of an advance bar 188 which is mounted for pivotal movement about rod 36. The advance bar 188 is disposed in a position such that it is engaged by the upward arm 26b of lever 26 thereby to move the advance bar against the bias of spring 190. A pair of links 192 and 194 are connected between the key actuated mechanism and each of the space bar 178 and advance bar 188 for advancing the carriage through one increment of movement upon each actuation of a lever or of the space bar. In general, however, the key actuated mechanism includes a ratchet wheel 196 supported by a shaft 198. The shaft is journalled for movement in a plate 200 carried by the carriage web portion (not shown) in a manner to extend forwardly of the base plate yet spaced below the rack 140. A gear 202 is mounted by the shaft 198 for conjoint movement with the ratchet wheel 96 in either direction of movement. A pawl 204 having a pair of extending arms 206 and 208 is mounted by a plate 200 in a position such that one of the arms is always in a position to cooperate between a pair of teeth on the ratchet wheel. As illustrated in FIG. 5, the ratchet wheel is biased for movement in the counterclockwise direction by the constant load of spring 210 secured between the web portion 148 of track mount 142 and structure carried by the track 128. The pawl 204 also includes an extension 212 which is disposed in the path of pivotal movement of an arm 214, one end of which is controlled by movement of the links 192 and 194. Thus, again referring to FIG. 6, a clockwise pivotal movement of arm 214 results in a counterclockwise movement of extension 212 of pawl 204 with the result that the arm 206 engages between the teeth of ratchet 196 momentarily after the arm 208 disengages from the teeth of the same ratchet wheel. The force of the bias of the constant load spring 210 through engagement of gear 202 and rack 140 causes the carriage to advance one step when the pawl returns to the position in FIG. 6. The pawl is biased to this position by springs 216 and 218 which are connected between the arms 206 and 208.

The carriage 102 may be backspaced against the bias of the constant load spring 210. This movement may be effected by manipulation of backspace lever 176. The mechanism for backspacing of the carriage includes a lever 220 which is pivotally mounted on plate 200 and biased by a spring 222 in the clockwise direction. The lever 220 includes a pin 223 which extends downwardly from one arm of the lever and cooperates through an aperture in a slide bar 224. The backspace mechanism includes a further lever 226 which is pivotally supported in a forward element 48 carried by the side elements 42 and 44. The lever 226 is connected by one arm to the slide bar and by the other arm to a link 230 whose other end is connected to the upward arm 176b of backspace lever 176. Actuation of the backspace lever 176 in the counterclockwise direction results in a clockwise movement of lever 226, a movement of slide bar 224 to the right, counterclockwise movement of lever 220 and a movement of carriage 102 to the right through one increment. This movement is enabled by a stepped movement of ratchet wheel 194 in a clockwise direction through engagement of lever 220 with a tooth of the ratchet wheel. As the ratchet wheel moves through a step in the clockwise direction the tooth following the arm 206 of pawl 204 cams the arm out of engagement between the teeth for movement of the ratchet wheel.

The advance bar 188 by means of a pair of links 232 (only one is shown) supported on opposite ends of the advance bar actuates the structure for advancing a ribbon 134 carried by a pair of spools 136. The space bar is also operable for purposes of raising the ribbon 134 into alignment with the surface of platen 110 thereby to permit transfer of any form of indicia carried by a type carrier 238 to the paper. As may be seen in FIG. 2, the type carrier includes indicia at locations 240, 242 and 244, which indicia, respectively, may be transferred to the paper when the carriage is in the FIG. 2, FIG. 1, and FIG. 3 positions.

As illustrated in FIG. 7, the ribbon 234 is supported by a guide 246 having spaced apart slots. The guide has an extending portion having a plurality of bent tabs 248 which engage on opposite sides of a channel member 250. The guide includes a cutout for receipt of a pivotal arm 252. The arm 252 is supported for pivotal movement by the channel member 250 and connected to a lever 254 through a link 256. A further link 258 connects the lever 254 to the advance bar 188 for the action described.

The control levers for movement of pawl 204 in the advance of the carriage, the backspace mechanism and the lever 254 for raising the guide 246 are all disposed on the forward element 48 mounted between the side elements 42 and 44.

While the description is believed to set out with specificity the structure and operation of mechanisms of the typewriter in addition to the more specific discussion directed to the shift mechanism, it may be that further discussion is necessary and for this purpose reference may be had to the aforementioned application which is included herein by reference.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

Having described the invention, what is claimed is:

1. In a typewriter comprising in combination a base having a front and rear portion, a carriage assembly located within and extending across said rear portion, said carriage assembly including a platen which is adapted for movement with said carriage assembly between a first position and either a second or third position located on opposite sides of said first position, a plurality of finger actuated members located within the front portion of said frame, said finger actuated members disposed in a plurality of tiers with each said tier including a plurality of said finger actuated members, means for supporting said finger actuated members of each tier for pivotal movement between a rest and an actuated position about pivot axes disposed substantially parallel to said carriage assembly, a plurality of type bars, a plurality of carriers upon which is disposed typing indicia at locations equal in number to the positions of said carriage assembly, each carrier mounted by one of said type bars, means supporting said type bars for pivotal movement toward said platen, means connecting respective ones of said finger actuated members and type bars so that when one of said finger actuated members is pivoted to said actuated position said type bar connected thereto also is pivoted whereby typing indicia at one of said locations strikes said platen, and wherein the improvement is in means for selective shifting of said carriage assembly from said first position to either said second or third position so that said platen may be struck by typing indicia at other of said locations, said shifting means comprising a. mounting means, said mounting means carried on and extending upwardly of said frame within the region of said rear portion,
b. first means adapted for shifting said carriage assembly from said first position to said second position, said first means including a first lever,
c. means pivotally supporting said first lever between its ends on said mounting means,
d. second means cooperable with said first means adapted for shifting said carriage assembly from said first position to said third position, said second means including a second lever,
e. means pivotally supporting said second lever between its ends on said mounting means,
f. track means,
g. means mounting said carriage assembly on said track means for movement with and along said track means,
h. means connecting said track means and said first lever adjacent one end,
i. means connecting one of said finger actuated members to said first lever adjacent the other end so that upon movement of said finger actuated member to said actuated position said first lever pivots in one direction to move said carriage assembly to said second position,
j. means connecting another of said finger actuated members to said second lever adjacent one end, and
k. means connecting the other end of said second lever to said first lever so that upon movement of said lastnamed finger actuated member to said actuated position said first lever pivots in a second direction to move said carriage assembly to said third position.

2. The typewriter of claim 1 wherein said mounting means includes a pair of plates, said plates being disposed on opposite sides of said base, and said means supporting said first lever includes an elongated rod, said elongated rod being supported by said plates and of a length greater than the spacing of said plates, said first lever being fixed at one end of said elongated rod.

3. The typewriter of claim 2 including a third lever, said third lever carried at the other end of said elongated rod for conjoint movement with said first lever, and means connecting yet another of said finger actuated members to said third lever.

4. The typewriter of claim 1 wherein said means of paragraph (i) includes a fourth lever, means mounting said fourth lever on said second lever at said one end, and a link connecting said fourth lever and said other end of said first lever.

5. The typewriter of claim 1 wherein said means of paragraph (k) includes a crank, means mounting said crank on said elongated rod, said crank mounting means permitting relative movement of said crank and elongated rod when said carriage assembly moves to said second position and conjoint movement of said crank and elongated rod when said carriage assembly moves to said third position.

6. The typewriter of claim 5 wherein said means of paragraph (k) further includes a fifth lever, means mounting said fifth lever on said mounting means, said fifth lever being mounted between its ends, one end of said fifth lever connected to the other end of said second lever, and the other end of said fifth lever connected to one end of said crank.

7. The typewriter of claim 5 wherein said crank includes a stop, said stop formed by a projection extending from said crank, and means carried by said first lever adjacent said one end for cooperating with said stop to locate said first position of said carriage assembly.

8. The typewriter of claim 6 including a spring, said spring connected between said one end of said second lever and said other end of said fifth lever for biasing said second and fifth levers in opposite directions.

9. The typewriter of claim 2 wherein said means of paragraph (h) includes frame means, said frame means including a pair of frame elements supported by said track means inwardly of said plates, said frame elements including at least one apertured ear and said plates including at least one slot elongated along an axis generally parallel to the path of movement of said carriage assembly, and a second elongated rod extending across said rear portion and through said plates, said second elongated rod also providing a coupling with said first lever at said one end.

* * * * *